US005833722A

United States Patent [19]

Davies et al.

[11] Patent Number: 5,833,722

[45] Date of Patent: Nov. 10, 1998

[54] FUEL OIL COMPOSITIONS WITH IMPROVED LUBRICITY PROPERTIES

[75] Inventors: Brian William Davies, Blewbury; Rinaldo Caprotti; Brid Dilworth, both of Oxford, all of United Kingdom

[73] Assignee: Exxon Chemical Patents, Inc., Linden, N.J.

[21] Appl. No.: 976,811

[22] PCT Filed: Dec. 13, 1995

[86] PCT No.: PCT/EP95/04929

§ 371 Date: Aug. 9, 1996

§ 102(e) Date: Aug. 9, 1996

[87] PCT Pub. No.: WO96/18706

PCT Pub. Date: Jun. 20, 1996

Related U.S. Application Data

[63] Continuation of Ser. No. 693,283, Aug. 9, 1996, abandoned.

[30] Foreign Application Priority Data

| | | | |
|---|---|---|---|
| Dec. 13, 1994 | [GB] | United Kingdom | 9425117 |
| Jul. 14, 1995 | [GB] | United Kingdom | 9514480 |

[51] Int. Cl.[6] ..... C10L 1/22; C10L 1/18

[52] U.S. Cl. ..... 44/418; 44/398; 44/412; 44/422

[58] Field of Search ..... 44/418, 398, 422

[56] References Cited

U.S. PATENT DOCUMENTS

| | | | |
|---|---|---|---|
| 3,273,981 | 9/1966 | Furey | 44/66 |
| 3,287,273 | 11/1966 | Furey et al. | 252/56 R |
| 3,429,817 | 2/1969 | Furey et al. | 44/398 |
| 3,522,179 | 7/1970 | LeSuer | 44/398 |
| 4,375,360 | 3/1983 | Washecheck et al. | 44/53 |
| 4,402,708 | 9/1983 | Oswald | 44/398 |
| 4,609,376 | 9/1986 | Craig et al. | 44/398 |
| 4,640,787 | 2/1987 | Schuettenberg | 44/418 |
| 4,874,395 | 10/1989 | Meyer | 44/398 |
| 5,004,478 | 4/1991 | Vogel et al. | 44/398 |
| 5,094,666 | 3/1992 | Feldman et al. | 44/418 |
| 5,139,534 | 8/1992 | Tomassen et al. | 44/418 |
| 5,378,249 | 1/1995 | Morrison | 44/388 |

FOREIGN PATENT DOCUMENTS

| | | | |
|---|---|---|---|
| 0 099 595 | 2/1984 | European Pat. Off. | C10L 1/24 |
| 356256 | 2/1990 | European Pat. Off. . | |
| 374461 | 6/1990 | European Pat. Off. . | |
| 398101 | 11/1990 | European Pat. Off. . | |
| 650118 | 2/1951 | United Kingdom . | |
| 94-10267 | 5/1994 | WIPO . | |
| 94-17159 | 8/1994 | WIPO . | |
| 94-17160 | 8/1994 | WIPO . | |
| 96-18706 | 6/1996 | WIPO . | |

OTHER PUBLICATIONS

Search Report for PCT/EP95/04929, Exxon Chemical Patents Inc., Dec.–1995.

*Primary Examiner*—Ellen M. McAvoy

*Attorney, Agent, or Firm*—Ohlandt, Greeley, Ruggiero & Perle

[57] ABSTRACT

The lubricity of low sulphur fuels is enhanced by incorporation of a lubricity enhancing additive in combination with a nitrogen compound.

25 Claims, No Drawings

FUEL OIL COMPOSITIONS WITH IMPROVED LUBRICITY PROPERTIES

This is a continuation of application Ser. No. 08/693,283, filed Aug. 8, 1996, now abandoned.

This invention relates to fuel oils, and to the use of additives to improve the characteristics of fuel oils, more especially of diesel fuel and kerosene.

Environmental concerns have led to a need for fuels with reduced sulphur content, especially diesel fuel and kerosene. However, the refining processes that produce fuels with low sulphur contents also result in a product of lower viscosity and a lower content of other components in the fuel that contribute to its lubricity, for example, polycyclic aromatics and polar compounds. Furthermore, sulphur-containing compounds in general are regarded as providing some anti-wear properties and a result of the reduction in their proportions, together with the reduction in proportions of other components providing lubricity, has been an increase in the number of reported problems in fuel pumps in diesel engines. The problems are caused by wear in, for example, cam plates, rollers, spindles and drive shafts, and include sudden pump failures relatively early in the life of the engine.

The problems may be expected to become worse in future because, in order to meet stricter requirements on exhaust emissions generally, higher pressure fuel systems, including in-line, rotary pumps and unit injector systems, are being introduced, these being expected to have more stringent lubricity requirements than present equipment, at the same time as lower sulphur levels in fuels become more widely required.

Historically, the typical sulphur content in a diesel fuel was below 0.5% by weight. In Europe maximum sulphur levels are being reduced to 0.20%, and are expected to be reduced to 0.05% in 1996; in Sweden grades of fuel with levels below 0.005% (Class 2) and 0.001% (Class 1) have already been introduced. A fuel oil composition with a sulphur level below 0.20% by weight is referred to herein as a low-sulphur fuel.

Such low-sulphur fuels may contain an additive to enhance their lubricity. These additives are of several types. In WO 94/17160, there is disclosed a low sulphur fuel comprising a carboxylic acid ester to enhance lubricity, more especially an ester in which the acid moiety contains from 2 to 50 carbon atoms and the alcohol moiety contains one or more carbon atoms. In U.S. Pat. No. 3,273,981, a mixture of a dimer acid, for example, the dimer of linoleic acid, and a partially esterified polyhydric alcohol is described for the same purpose. In U.S. Pat. No. 3,287,273, the use of an optionally hydrogenated dimer acid glycol ester is described. Other materials used as lubricity enhancers, or anti-wear agents as they are also termed, include a sulphurized dioleyl norbornene ester (EP-A-99595), castor oil (U.S. Pat. No. 4,375,360 and EP-A-605857) and, in methanol-containing fuels, a variety of alcohols and acids having from 6 to 30 carbon atoms, acid and alcohol ethoxylates, mono- and di-esters, polyol esters, and olefin-carboxylic acid copolymers and vinyl alcohol polymers (also U.S. Pat. No. 4,375,360). GB-A-650118 describes solubilizing partial esters by amine salts. The disclosures of the above identified documents are incorporated by reference herein.

The present invention is based on the observation that the presence of at least one nitrogen compound carrying one or more substituents of the formula>$NR^{13}$, wherein $R^{13}$ represents a hydrocarbyl group containing 8 to 40 carbon atoms further enhances the lubricity of a low-sulphur fuel oil containing a lubricity enhancer. The combination of conventional lubricity enhancer and at least one such compound can provide excellent lubricity enhancement, allowing a higher level of lubricity to be obtained for a fixed amount of conventional lubricity enhancer. Alternatively, an equivalent level of lubricity can be provided whilst allowing a lower amount of the conventional lubricity enhancer to be used.

According to the first aspect of the invention, there is provided a composition comprising a major proportion of a fuel oil and minor proportions of a lubricity enhancer and at least one nitrogen compound carrying one or more substituents of the formula>$NR^{13}$, wherein $R^{13}$ represents a hydrocarbyl group containing 8 to 40 carbon atoms, the sulphur content of the composition being at most 0.2% by weight.

Advantageously, the sulphur content of the composition is at most 0.05% by weight.

Advantageously, the fuel oil is a petroleum-based fuel oil, such as a middle distillate fuel oil. However, the fuel oil may also be a mixture of petroleum-based fuel oil and vegetable-based fuel oil.

In a second aspect of the invention, there is provided a process for the manufacture of a preferred composition of the first aspect, which comprises refining a crude oil to produce a petroleum-based fuel oil of low sulphur content, and blending with this refined product a lubricity enhancer and at least one nitrogen compound carrying one or more substituents of the formula>$NR^{13}$, wherein $R^{13}$ represents a hydrocarbyl group containing 8 to 40 carbon atoms and optionally a vegetable-based fuel oil to provide a composition with a sulphur content of at most 0.2% by weight, preferably of at most 0.05% by weight, and having a lubricity such as to give a wear scar diameter, as measured by the HFRR test (as hereinafter defined) at 60° C. of at most 500 $\mu$m. Preferably, the wear scar diameter is at most 450 $\mu$m.

Also advantageously, the fuel oil comprising the major proportion of the composition of the first aspect may be a vegetable-based fuel oil. In a third aspect of the invention, there is provided a process for the manufacture of another preferred composition of the first aspect, which comprises blending a vegetable-based fuel oil of low sulphur content with a lubricity enhancer and at least one nitrogen compound carrying one or more substituents of the formula>$NR^{13}$, wherein $R^{13}$ represents a hydrocarbyl group containing 8 to 40 carbon atoms, to provide a composition with a sulphur content of at most 0.2% by weight and having a lubricity such as to give a wear scar diameter, as measured by the HFRR test at 60° C., of at most 500 $\mu$m.

In a fourth aspect of the invention, there is provided the use of at least one nitrogen compound carrying one or more substituents of the formula>$NR^{13}$, wherein $R^{13}$ represents a hydrocarbyl group containing 8 to 40 carbon atoms to enhance the lubricity of a fuel oil composition having a sulphur content of at most 0.2% by weight, more especially of at most 0.05% by weight, and also comprising a lubricity enhancer.

The composition of the first aspect of the invention, and the composition resulting from the use of the fourth aspect, preferably have a lubricity as defined in relation to the second and third aspects.

As used herein, the term "middle distillate" refers to petroleum-based fuel oils obtainable in refining crude oil as the fraction from the lighter, kerosene or jet fuel, fraction to the heavy fuel oil fraction. These fuel oils may also comprise atmospheric or vacuum distillate, cracked gas oil or a blend, in any proportions, of straight run and thermally and/or catalytically cracked distillate. Examples include kerosene, jet fuel, diesel fuel, heating oil, visbroken gas oil, light cycle oil, vacuum gas oil, light fuel oil and fuel oil. Such middle distillate fuel oils usually boil over a temperature range, generally within the range of 100° C. to 500° C., as measured according to ASTM D86, more especially between 150° C. and 400° C.

Preferred vegetable-based fuel oils are triglycerides of monocarboxylic acids, for example acids containing 10–25 carbon atoms, and typically have the general formula shown below $$\begin{array}{l} CH_2OCOR \\ | \\ CHOCOR \\ | \\ CH_2OCOR \end{array}$$

where R is an aliphatic radical of 10–25 carbon atoms which may be saturated or unsaturated.

Generally, such oils contain glycerides of a number of acids, the number and kind varying with the source vegetable of the oil.

Examples of oils are rapeseed oil, coriander oil, soyabean oil, cottonseed oil, sunflower oil, castor oil, olive oil, peanut oil, maize oil, almond oil, palm kernel oil, coconut oil, mustard seed oil, beef tallow and fish oils. Rapeseed oil, which is a mixture of fatty acids partially esterified with glycerol, is preferred as it is available in large quantities and can be obtained in a simple way by pressing from rapeseed.

Further preferred examples of vegetable-based fuel oils are alkyl esters, such as methyl esters, of fatty acids of the vegetable or animal oils. Such esters can be made by transesterification.

As lower alkyl esters of fatty acids, consideration may be given to the following, for example as commercial mixtures: the ethyl, propyl, butyl and especially methyl esters of fatty acids with 12 to 22 carbon atoms, for example of lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid or erucic acid, which have an iodine number from 50 to 150, especially 90 to 125. Mixtures with particularly advantageous properties are those which contain mainly, i.e. to at least 50 wt % methyl esters of fatty acids with 16 to 22 carbon atoms and 1, 2 or 3 double bonds. The preferred lower alkyl esters of fatty acids are the methyl esters of oleic acid, linoleic acid, linolenic acid and erucic acid.

Commercial mixtures of the stated kind are obtained for example by cleavage and esterification of natural fats and oils by their transesterification with lower aliphatic alcohols. For production of lower alkyl esters of fatty acids it is advantageous to start from fats and oils with high iodine number, such as, for example, sunflower oil, rapeseed oil, coriander oil, castor oil, soyabean oil, cottonseed oil, peanut oil or beef tallow. Lower alkyl esters of fatty acids based on a new variety of rapeseed oil, the fatty acid component of which is derived to more than 80 wt % from unsaturated fatty acids with 18 carbon atoms, are preferred.

Most preferred as a vegetable-based fuel oil is rapeseed methyl ester.

The HFRR, or High Frequency Reciprocating Rig, test is a measure of in-use lubricity of treated fuel, and is that described in CEC PF 06-T-94 or ISO/TC22/SC7/WG6/N188.

A fuel oil has an inherent lubricity. A lubricity enhancer is an additive capable of statistically significantly increasing that inherent lubricity as measured, for example, by HFRR, the statistical significance of the increase taking into consideration the repeatability of the test. Other tests may be used as a measure of lubricity and hence to establish if a given additive is functioning in a given fuel oil as a lubricity enhancer. Among these tests there may especially be mentioned the Ball on Cylinder Lubricant Evaluator (BOCLE) test described in "Friction & Wear Devices", 2nd Edition, p. 280, American Society of Lubrication Engineers, Park Ridge, Ill., U.S.A. and F. Tao and J. Appledorn, ASLE Trans., 11, 345 to 352 (1968).

The nitrogen compounds are oil-soluble nitrogen compounds carrying one or more, preferably two or more, substituents of the formula>$NR^{13}$, where $R^{13}$ represents a hydrocarbyl group containing 8 to 40 carbon atoms, which substituent or one or more of which substituents may be in the form of a cation derived therefrom. The oil soluble polar nitrogen compound is generally one capable of acting as a wax crystal growth inhibitor in fuels.

Preferred nitrogen compounds are amine salts and/or amides formed by reacting at least one molar proportion of a hydrocarbyl-substituted amine and a molar proportion of a hydrocarbyl acid having from 1 to 4 carboxylic acid groups or its anhydride, the substituent(s) of formula>$NR^{13}$ being of the formula —$NR^{13}R^{14}$ where $R^{13}$ is defined as above and $R^{14}$ represents hydrogen or $R^{13}$, provided that $R^{13}$ and $R^{14}$ may be the same or different, said substituents constituting part of the amine salt and/or amide groups of the compound.

Ester/amides may be used, containing 30 to 300, preferably 50 to 150, total carbon atoms. These nitrogen compounds are described in U.S. Pat. No. 4,211,534. Suitable amines are predominantly $C_{12}$ to $C_{40}$ primary, secondary, tertiary or quaternary amines or mixtures thereof but shorter chain amines may be used provided the resulting nitrogen compound is oil soluble, normally containing about 30 to 300 total carbon atoms. The nitrogen compound preferably contains at least one straight chain $C_8$ to $C_{40}$, preferably $C_{14}$ to $C_{24}$, alkyl segment.

Suitable amines include primary, secondary, tertiary or quaternary, but are preferably secondary. Tertiary and quaternary amines only form amine salts. Examples of amines include tetradecylamine, cocoamine, and hydrogenated tallow amine. Examples of secondary amines include dioctacedyl amine and methylbehenyl amine. Amine mixtures are also suitable such as those derived from natural materials. A preferred amine is a secondary hydrogenated tallow amine, the alkyl groups of which are derived from hydrogenated tallow fat composed of approximately 4% $C_{14}$, 31% $C_{16}$, and 59% $C_{18}$.

Examples of suitable carboxylic acids and their anhydrides for preparing the nitrogen compounds include ethylenediamine tetraacetic acid, and carboxylic acids based on cyclic skeletons, e.g., cyclohexane-1,2-dicarboxylic acid, cyclohexene-1,2-dicarboxylic acid, cyclopentane-1,2-dicarboxylic acid and naphthalene dicarboxylic acid, and 1,4-dicarboxylic acids including dialkyl spirobislactones. Generally, these acids have about 5 to 13 carbon atoms in the cyclic moiety. Preferred acids useful in the present invention are benzene dicarboxylic acids e.g., phthalic acid, isophthalic acid, and terephthalic acid. Phthalic acid and its anhydride are particularly preferred. The particularly preferred compound is the amide-amine salt formed by reacting 1 molar portion of phthalic anhydride with 2 molar portions of dihydrogenated tallow amine. Another preferred compound is the diamide formed by dehydrating this amide-amine salt.

Other examples are long chain alkyl or alkylene substituted dicarboxylic acid derivatives such as amine salts of monoamides of substituted succinic acids, examples of which are known in the art. Suitable amines may be those described above.

Further nitrogen compound examples are those containing a cyclic ring system carrying at least two substituents of the general formula below on the ring system $$—A—NR^{15}R^{16}$$

where A is a linear or branched chain aliphatic hydrocarbylene group optionally interrupted by one or more hetero atoms, and $R^{15}$ and $R^{16}$ are the same or different and each is independently a hydrocarbyl group containing 9 to 40 atoms optionally interrupted by one or the substituents being the same or more hetero atoms, the substituents being the same or different and the compound optionally being in the form of a salt thereof. Advantageously, A has from 1 to 20 carbon atoms and is preferably a methylene or polymethylene group.

The or each nitrogen compound is advantageously employed in a proportion within the range of from 0.005% to 1%, advantageously 0.01% to 0.5%, and preferably from 0.015% to 0.20%, by weight, based on the weight of fuel oil.

As lubricity enhancer, there may be used any one or more of the conventional types of compounds mentioned above and, more especially, an ester of a polyhydric alcohol and a carboxylic acid, in particular an ester of an acid moiety which contains from 2 to 50 carbon atoms, and an alcohol moiety which contains one or more carbon atoms.

Advantageously the carboxylic acid is a polycarboxylic acid, preferably a dicarboxylic acid, preferably having between 9 and 42 carbon atoms, more especially between 12 and 42 carbon atoms, between the carbonyl groups, the alcohol advantageously having from 2 to 8 carbon atoms and from 2 to 6 hydroxy groups.

Advantageously, the ester has a molecular weight of at most 950, preferably of at most 800. The dicarboxylic acid may be saturated or unsaturated; advantageously it is an optionally hydrogenated "dimer" acid, preferably a dimer of oleic or, especially linoleic acid, or a mixture thereof. The alcohol is advantageously a glycol, more advantageously an alkane or oxaalkane glycol, preferably ethylene glycol. The ester may be a partial ester of the polyhydric alcohol and may contain a free hydroxy group or groups; however, advantageously any acid groups not esterified by the glycol are capped by a monohydric alcohol, for example, methanol. It is within the scope of the invention to use two or more lubricity enhancers.

Another preferred lubricity enhancer is a mixture of esters comprising:

(a) an ester of an unsaturated monocarboxylic acid and a polyhydric alcohol, and (b) an ester of an unsaturated monocarboxylic acid and a polyhydric alcohol having at least three hydroxy groups, the esters (a) and (b) being different.

The term 'polyhydric alcohol' is used herein to describe a compound having more than one hydroxy-group. It is preferred that (a) is the ester of a polyhydric alcohol having at least three hydroxy groups.

Examples of polyhydric alcohols having at least three hydroxy groups are those having 3 to 10, preferably 3 to 6, more preferably 3 to 4 hydroxy groups and having 2 to 90, preferably 2 to 30, more preferably 2 to 12 and most preferably 3 to 4 carbon atoms in the molecule. Such alcohols may be aliphatic, saturated or unsaturated, and straight chain or branched, or cyclic derivatives thereof.

Advantageously, both (a) and (b) are esters of trihydric alcohols, especially glycerol or trimethylol propane. Other suitable polyhydric alcohols include pentaerythritol, sorbitol, mannitol, inositol, glucose and fructose.

The unsaturated monocarboxylic acids from which the esters are derived may have an alkenyl, cyclo alkenyl or aromatic hydrocarbyl group attached to the carboxylic acid group. The term 'hydrocarbyl' means a group containing carbon and hydrogen which may be straight chain or branched and which is attached to the carboxylic acid group by a carbon-carbon bond. The hydrocarbyl group may be interrupted by one or more hetero atoms such as O, S, N or P.

It is preferred that (a) and (b) are both esters of alkenyl monocarboxylic acids, the alkenyl groups preferably having 10 to 36, for example 10 to 22, more preferably 18–22, especially 18 to 20 carbon atoms. The alkenyl group may be mono- or poly-unsaturated. It is particularly preferred that (a) is an ester of a mono-unsaturated alkenyl monocarboxylic acid, and that (b) is an ester of a poly-unsaturated alkenyl monocarboxylic acid. The poly-unsaturated acid is preferably di- or tri- unsaturated. Such acids may be derived from natural materials, for example vegetable or animal extracts.

Especially-preferred mono-unsaturated acids are oleic and elaidic acid. Especially preferred poly-unsaturated acids are linoleic and linolenic acid.

The esters may be partial or complete esters, i.e. some or all of the hydroxy groups of each polyhydric alcohol may be esterified. It is preferred that at least one of (a) or (b) is a partial ester, particularly a monoester. Especially good performance is obtained where (a) and (b) are both monoesters.

The esters may be prepared by methods well known in the art, for example by condensation reactions. If desired, the alcohols may be reacted with acid derivatives such as anhydrides or acyl chlorides in order to facilitate the reaction and improve yields.

The esters (a) and (b) may be separately prepared and then mixed together, or may be prepared together from a mixture of starting materials. In particular, commercially-available mixtures of suitable acids may be reacted with a selected alcohol such as glycerol to form a mixed ester product according to this invention. Particularly-preferred commercial acid mixtures are those comprising oleic and linoleic acids. In such mixtures, minor proportions of other acids, or acid polymerisation products, may be present but these should not exceed 15%, more preferably not more than 10%, and most preferably not more than 5% by weight of the total acid mixture.

Similarly, mixtures of esters may be prepared by reacting a single acid with a mixture of alcohols.

A highly-preferred ester mixture is that obtained by reacting a mixture of oleic and linoleic acids with glycerol, the mixture comprising predominantly (a) glycerol monooleate and (b) glycerol monolinoleate, preferably in approximately equal proportions by weight.

Alternative to the above described esters, or in combination therewith, the lubricity enhancer may comprise one or more carboxylic acids of the types described above in relation to the ester lubricity enhancers. When such acids are monocarboxylic acids, they may furthermore be saturated acids, particularly saturated straight or branched chain fatty acid mixtures.

The lubricity enhancer is advantageously employed in a proportion within the range of from 0.0001% to 10%, more advantageously 0.015% to 0.3%, and preferably from 0.02% to 0.2%, by weight, based on the weight of fuel oil.

The or each nitrogen compound and the lubricity enhancer may be incorporated in the fuel oil either separately or, preferably, in combination, for example in the form of an additive blend or additive concentrate.

Numerous other co-additives are suitable for use in the composition of the first aspect, or composition resulting from the use of the fourth aspect, of the invention.

Examples of such co-additives are detailed below.

1. A comb polymer: such polymers are polymers in which branches containing hydrocarbyl groups are pendant from a polymer backbone, and are discussed in "Comb-Like Polymers. Structure and Properties", N. A. Platé and V. P. Shibaev, J. Poly. Sci. Macromolecular Revs., 8, p 117 to 253 (1974).

Generally, comb polymers have one or more long chain hydrocarbyl branches, e.g., oxyhydrocarbyl branches, normally having from 10 to 30 carbon atoms, pendant from a polymer backbone, said branches being bonded directly or indirectly to the backbone. Examples of indirect bonding include bonding via interposed atoms or groups, which bonding can include covalent and/or electrovalent bonding such as in a salt.

Advantageously, the comb polymer is a homopolymer having, or a copolymer at least 25 and preferably at least 40, more preferably at least 50, molar per cent of the units of which have, side chains containing at least 6, and preferably at least 10, atoms.

As examples of preferred comb polymers there may be mentioned those of the general formula

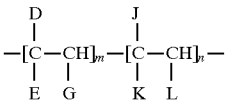

wherein

D=$R^{11}$, $COOR^{11}$, $OCOR^{11}$, $R^{12}COOR^{11}$, or $OR^{11}$,

E=H, $CH_3$, D, or $R^{12}$

G=H or D

J=H, $R^{12}$, $R^{12}COOR^{11}$, or an aryl or heterocyclic group,

K=H, $COOR^{12}$, $OCOR^{12}$, $OR^{12}$, or COOH,

L=H, $R^{12}$, $COOR^{12}$, $OCOR^{12}$, COOH, or aryl, $R^{11} \geqq C_{10}$ hydrocarbyl, $R^{12} \geqq C_1$ hydrocarbyl or hydrocarbylene, and m and n represent mole fractions, m being finite and preferably within the range of from 1.0 to 0.4, n being less than 1 and preferably in the range of from 0 to 0.6. $R^{11}$ advantageously represents a hydrocarbyl group with from 10 to 30 carbon atoms, while $R^{12}$ advantageously represents a hydrocarbyl group with from 1 to 30 carbon atoms.

The comb polymer may contain units derived from other monomers if desired or required.

These comb polymers may be copolymers of maleic anhydride or fumaric or itaconic acids and another ethylenically unsaturated monomer, e.g., an α-olefin, including styrene, or an unsaturated ester, for example, vinyl acetate, or homopolymers of fumaric or itaconic acids. It is preferred but not essential that equimolar amounts of the comonomers be used although molar proportions in the range of 2 to 1 and 1 to 2 are suitable. Examples of olefins that may be copolymerized with e.g., maleic anhydride, include 1-decene, 1-dodecene, 1tetradecene, 1-hexadecene, and 1-octadecene.

The acid or anhydride group of the comb polymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-l-ol. The alcohols may also include up to one methyl branch per chain, for example, 1-methylpentadecan1-ol or 2-methyltridecan-1-ol. The alcohol may be a mixture of normal and single methyl branched alcohols. It is preferred to use pure alcohols rather than the commercially available alcohol mixtures but if mixtures are used the $R^{12}$ refers to the average number of carbon atoms in the alkyl group; if alcohols that contain a branch at the 1 or 2 positions are used $R^{12}$ refers to the straight chain backbone segment of the alcohol.

These comb polymers may especially be fumarate or itaconate polymers and copolymers.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight. The particularly preferred comb polymers are those having a number average molecular weight, as measured by vapour phase osmometry, of 1,000 to 100,000, more especially 1,000 to 30,000.

Other suitable comb polymers are the polymers and copolymers of α-olefins and esterified copolymers of styrene and maleic anhydride, and esterified copolymers of styrene and fumaric acid; mixtures of two or more comb polymers may be used in accordance with the invention and, as indicated above, such use may be advantageous. Other examples of comb polymers are hydrocarbon polymers, e.g., copolymers of ethylene and at least one α-olefin, the α-olefin preferably having at most 20 carbon atoms, examples being n-decene-1 and n-dodecene-1. Preferably, the number average molecular weight of such a copolymer is at least 30,000 measured by GPC. The hydrocarbon copolymers may be prepared by methods known in the art, for example using a Ziegler type catalyst.

2. Particularly suitable ethylene-unsaturated ester copolymers are those having, in addition to units derived from ethylene, units of the formula $$—CR^1R^2—CHR^3—$$

wherein $R^1$ represents hydrogen or methyl; $R^2$ represents $COOR^4$, wherein $R^4$ represents an alkyl group having from 1 to 9 carbon atoms which is straight chain or, if it contains 3 or more carbon atoms, branched, or $R^2$ represents $OOCR^5$, wherein $R^5$ represents $R^4$ or H; and $R^3$ represents H or $COOR^4$.

These may comprise a copolymer of ethylene with an ethylenically unsaturated ester, or derivatives thereof. An example is a copolymer of ethylene with an ester of a saturated alcohol and an unsaturated carboxylic acid, but preferably the ester is one of an unsaturated alcohol with a saturated carboxylic acid. An ethylene-vinyl ester copolymer is advantageous; an ethylene-vinyl acetate, ethylene-vinyl propionate, ethylene-vinyl hexanoate, or ethylene-vinyl octanoate copolymer is preferred. Preferably, the copolymer contains from 5 to 40 wt % of the vinyl ester, more preferably from 10 to 35 wt % vinyl ester. A mixture of two or more such copolymers, for example as described in U.S. Pat. No. 3,961,916, may be used. The number average molecular weight of the copolymer, as measured by vapour phase osmometry, is advantageously 1,000 to 10,000, preferably 1,000 to 5,000. If desired, the copolymer may contain units derived from additional comonomers, e.g. a terpolymer, tetrapolymer or a higher polymer, for example where the additional comonomer is isobutylene or disobutylene.

The copolymers may be made by direct polymerization of comonomers, or by transesterification, or by hydrolysis and re-esterification, of an ethylene unsaturated ester copolymer to give a different ethylene unsaturated ester copolymer. For example, ethylene-vinyl hexanoate and ethylene-vinyl octanoate copolymers may be made in this way, e.g., from an ethylene-vinyl acetate copolymer.

3. Suitable hydrocarbon polymers are those of the general formula

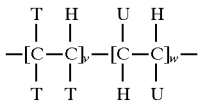

wherein

T=H or $R^{21}$ wherein $R^{21}$=$C_1$ to $C_{40}$ hydrocarbyl, and

U=H, T, or aryl and v and w represent mole fractions, v being within the range of from 1.0 to 0.0, w being in the range of from 0.0 to 1.0.

The hydrocarbon polymers may be made directly from monoethylenically unsaturated monomers or indirectly by hydrogenating polymers from polyunsaturated monomers, e.g., isoprene and butadiene.

Preferred copolymers are ethylene α-olefin copolymers, having a number average molecular weight of at least 30,000. Preferably the α-olefin has at most 28 carbon atoms. Examples of such olefins are propylene, 1butene, isobutene, n-octene-l, isooctene-l, n-decene-l, and n-dodecene-1. The copolymer may also comprise small amounts, e.g., up to 10% by weight, of other copolymerizable monomers, for example olefins other than α-olefins, and non-conjugated dienes. The preferred copolymer is an ethylene-propylene copolymer.

The number average molecular weight of the ethylene α-olefin copolymer is, as indicated above, preferably at least 30,000, as measured by gel permeation chromatography (GPC) relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000.

Advantageously, the copolymer has a molar ethylene content between 50 and 85 per cent. More advantageously, the ethylene content is within the range of from 57 to 80%, and preferably it is in the range from 58 to 73%; more preferably from 62 to 71%, and most preferably 65 to 70%.

Preferred ethylene-α-olefin copolymers are ethylene propylene copolymers with a molar ethylene content of from 62 to 71% and a number average molecular weight in the range 60,000 to 120,000; especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. The polymers should be substantially amorphous, since highly crystalline polymers are relatively insoluble in fuel oil at low temperatures.

Other suitable hydrocarbon polymers include a low molecular weight ethylene-α-olefin copolymer, advantageously with a number average molecular weight of at most 7500, advantageously from 1,000 to 6,000, and preferably from 2,000 to 5,000, as measured by vapour phase osmometry. Appropriate α-olefins are as given above, or styrene, with propylene again being preferred. Advantageously the ethylene content is from 60 to 77 molar per cent, although for ethylene-propylene copolymers up to 86 molar per cent by weight ethylene may be employed with advantage.

4. A polyoxyalkylene compound. Examples are polyoxyalkylene esters, ethers, ester/ethers and mixtures thereof, particularly those containing at least one, preferably at least two, $C_{10}$ to $C_{30}$ linear alkyl groups and a polyoxyalkylene glycol group of molecular weight up to 5,000, preferably 200 to 5,000, the alkyl group in said polyoxyalkylene glycol containing from 1 to 4 carbon atoms.

The preferred esters, ethers or ester/ethers are those of the general formula $$R^{31}—O(D)—O—R^{32}$$

where $R^{31}$ and $R^{32}$ may be the same or different and represent (a) n-alkyl—

(b) n-alkyl—CO—

(c) n-alkyl—O—$CO(CH_2)_x$— or (d) n-alkyl—O—$CO(CH_2)_x$—CO— x being, for example, 1 to 30, the alkyl group being linear and containing from 10 to 30 carbon atoms, and D representing the polyalkylene segment of the glycol in which the alkylene group has 1 to 4 carbon atoms, such as a polyoxymethylene, polyoxyethylene or polyoxytrimethylene moiety which is substantially linear; some degree of branching with lower alkyl side chains (such as in polyoxypropylene glycol) may be present but it is preferred that the glycol is substantially linear. D may also contain nitrogen.

Examples of suitable glycols are substantially linear polyethylene glycols (PEG) and polypropylene glycols (PPG) having a molecular weight of from 100 to 5,000, preferably from 200 to 2,000. Esters are preferred and fatty acids containing from 10–30 carbon atoms are useful for reacting with the glycols to form the ester additives, it being preferred to use a $C_{18}$–$C_{24}$ fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, diesters being preferred for use in narrow boiling distillates, when minor amounts of monoethers and monoesters (which are often formed in the manufacturing process) may also be present. It is preferred that a major amount of the dialkyl compound be present. In particular, stearic or behenic diesters of polyethylene glycol, polypropylene glycol or polyethylene/polypropylene glycol mixtures are preferred.

It is within the scope of the invention to use two or more co-additives advantageously selected from one or more of the different classes outlined above.

Further co-additives known in the art, include for example the following: detergents, antioxidants, corrosion inhibitors, dehazers, demulsifiers, antifoaming agents, cetane improvers, cosolvents, and package compatibilizers.

THE FOLLOWING EXAMPLES ILLUSTRATE THE INVENTION

In the examples, the HFRR test was employed at 60° C. in accordance with the above-identified ISO procedure.

Friction between test surfaces was monitored continuously, wear being measured at the end of the test.

Various additives were tested in a diesel fuel. The characteristics of the fuel were as follows:

| | | Fuel 2 |
|---|---|---|
| Specific Gravity: | | 0.8153 |
| Sulphur, wt %: | | 0.00045 |
| Distillation, °C., | IBP | 176 |
| D86, °C. | 10% | 206 |
| | 50% | 237 |
| | 90% | 271 |
| | 95% | 279 |
| | FBP | 294 |

Two additives were used in the Example, the results and the treat rates, in ppm, being given in the Table. Two values of treat rate are given: the first for the additive concentrate, i.e., including solvent, and the second, in parentheses, for the active ingredient.

Additives Used

Additive C

A polar nitrogen compound, an N,N-dialkylammonium salt of 2-N'N' dialkylamidobenzoate, the product of reacting one mole of phthalic anhydride and two moles of di(hydrogenated tallow) amine.

Additive D

The ester obtained by esterifying dilinoleic acid, a $C_{36}$ dimer acid, with ethylene glycol, and neutralizing free acid groups with methanol.

Example 1

In this example, using Fuel 2, the HFRR test was carried out using no additive as Control; additive C, and additive D in various concentrations, given in Table 2 in ppm.

TABLE 2

| Additive C | Additive D | Wear Scar, μm | Friction |
|---|---|---|---|
| 0 | 0 | 656 | 0.56 |
| 0 | 200 (120) | 637 | 0.39 |
| 0 | 200 (120) | 661 | 0.39 |
| 0 | 200 (120) | 615 | 0.35 |
| 0 | 250 (150) | 625 | 0.38 |
| 0 | 400 (240) | 405 | 0.14 |
| 0 | 600 (360) | 400 | 0.13 |
| 100 (67) | 0 | 572 | 0.33 |
| 200 (134) | 0 | 507 | 0.28 |
| 500 (334) | 0 | 400 | 0.20 |
| 100 (67) | 200 (120) | 450 | 0.23 |
| 200 (134) | 200 (120) | 349 | 0.18 |
| 100 (67) | 250 (150) | 435 | 0.22 |

The results show that, at low treat rates, the lubricity enhancer D did not effect an increase in lubricity when used alone in this fuel. At comparable total treat rates, however, addition of both the cold flow additive C and additive D caused an increase in lubricity greater than that arising from use of additive C alone.

At a treat rate of 400 (240) ppm, Additive D alone gives good results. A treat rate of 200 (134) ppm of Additive C and 200 (120) ppm additive D also gives good results. Taking into consideration that cold flow improvement would normally also be desired, this enables the quantity of lubricity enhancer to be reduced.

We claim:

1. A composition comprising a major proportion of a fuel oil and minor proportions of a lubricity enhancer and at least one nitrogen compound carrying one or more substituents of the formula>$NR^{13}$, wherein $R^{13}$ represents a hydrocarbyl group containing 8 to 40 carbon atoms, the sulphur content of the composition being at most 0.2% by weight.

2. The composition of claim 1, having a lubricity such as to give a wear scar diameter, as measured by the HFRR test at 60° C., of at most 500 μm.

3. The composition of claim 1 or claim 2, wherein the sulphur content of the composition is at most 0.05% by weight.

4. The composition of claim 1, wherein the nitrogen compound is an amine salt and/or amide formed by reacting at least one molar proportion of a hydrocarbyl-substituted amine and a molar proportion of a hydrocarbyl acid having from 1 to 4 carboxylic acid groups or its anhydride.

5. The composition of claim 4, wherein the nitrogen compound is the amide—amine salt formed by reacting 1 molar portion of phthalic anhydride with 2 molar proportions of dihydrogenated tallow amine.

6. The composition of claim 1, wherein the lubricity enhancer is one or more esters of a polyhydric alcohol and a carboxylic acid.

7. The composition of claim 6, wherein the alcohol has from 2 to 8 carbon atoms and the acid is a dicarboxylic acid having between 9 and 42 carbon atoms between the carbonyl groups.

8. The composition of claim 6, wherein the lubricity enhancer is an ester mixture comprising glycerol monooleate and glycerol monolinoleate.

9. A process for the manufacture of the composition of claim 1, which comprises refining a crude oil to produce a petroleum-based fuel oil of low sulphur content, and blending with this refined product a lubricity enhancer and at least one nitrogen compound carrying one or more substituents of the formula>$NR^{13}$, wherein $R^{13}$ represents a hydrocarbyl group containing 8 to 40 carbon atoms and optionally a vegetable-based fuel oil, to provide a composition with a sulphur content of at most 0.2% by weight and having a lubricity such as to give a wear scar diameter, as measured by the HFRR test at 60° C., of at most 500 μm.

10. A process for the manufacture of the composition of claim 1 which comprises blending a vegetable-based fuel oil of low sulphur content with a lubricity enhancer and at least one nitrogen compound carrying one or more substituents of the formula>$NR^{13}$, wherein $R^{13}$ represents a hydrocarbyl group containing 8 to 40 carbon atoms, to provide a composition with a sulphur content of at most 0.2% by weight and having a lubricity such as to give a wear scar diameter, as measured by the HFRR test at 60° C., of at most 500 μm.

11. The composition of claim 1 wherein there is present 0.005% to 1% by weight of the nitrogen compound and 0.0001% to 10% by weight of the lubricity enhancer.

12. A composition of claim 1 having a lubricity such as to give a wear scar diameter, as measured by the HFRR test at 60° C. of at most 450 μm.

13. A composition of claim 1 wherein the lubricity enhancer is present in an amount of from about 0.001 to about 10% by weight, the nitrogen compound is present in an amount of from about 0.005 to about 1% by weight, the lubricant enhancer is one or more ester of a polyhydric alcohol having from 2 to 6 carbon atoms and an unsaturated dicarboxylic acid having from 12 to 42 carbon atoms between carboxyl groups, and the nitrogen compound is an amine salt and/or amide formed by reacting at least one molar proportion of a hydrocarbyl-substituted amine and a molar proportion of a hydrocarbyl acid having from 1 to 4 carboxylic acid groups or its anhydride.

14. A composition of claim 13 wherein the lubricity enhancer is selected from the group consisting of the ester obtained by esterifying dilinoleic acid with ethylene glycol and neutralizing free acid groups with methanol or an ester mixture comprising glycerol monooleate and glycerol monolinoleate, and the nitrogen compound is the amide-amine salt formed by reacted 1 molar portion of phthalic anhydride with 2 molar proportions of dihydrogenated tallow amine.

15. A composition of claim 14 wherein the lubricity enhancer is the ester obtained by esterifying dilinoleic acid with ethylene glycol and neutralizing free acid groups with methanol or an ester mixture comprising glycerol monooleate and glycerol monolinoleate.

16. A composition of claim 15 wherein the sulphur content of the composition is at most 0.05% by weight.

17. A composition of claim 16 wherein the fuel oil is a middle distillate fuel oil.

18. A composition of claim 16 wherein the fuel oil is a diesel fuel.

19. The method of improving the lubricity of a fuel oil composition having a sulfur content of at most 0.2% by weight and also comprising a lubricity enhancer which comprises adding to said composition at least one nitrogen compound carrying one or more substituents of the formula>$NR^{13}$ wherein $R^{13}$ represents a hydrocarbyl group containing 8 to 40 carbon atoms whereby the lubricity of the fuel oil composition is improved.

20. The method of claim 19 wherein the lubricity enhancer is present in an amount of from about 0.001 to about 10% by weight, the nitrogen compound is present in an amount of from about 0.005 to about 1% by weight, the lubricant enhancer is one or more ester of a polyhydric alcohol having from 2 to 6 carbon atoms and an unsaturated dicarboxylic acid having from 12 to 42 carbon atoms between carboxyl groups, and the nitrogen compound is an amine salt and/or amide formed by reacting at least one molar proportion of a hydrocarbyl-substituted amine and a molar proportion of a hydrocarbyl acid having from 1 to 4 carboxylic acid groups or its anhydride.

21. The method of claim 20 wherein the lubricity enhancer is selected from the group consisting of the ester obtained by esterifying dilinoleic acid with ethylene glycol and neutralizing free acid groups with methanol or an ester mixture comprising glycerol monooleate and glycerol monolinoleate, and the nitrogen compound is the amide-amine salt formed by reacted 1 molar portion of phthalic anhydride with 2 molar proportions of dihydrogenated tallow amine.

22. The method of claim 21 wherein the lubricity enhancer is the ester obtained by esterifying dilinoleic acid with ethylene glycol and neutralizing free acid groups with methanol or an ester mixture comprising glycerol monooleate and glycerol monolinoleate.

23. The method of claim 22 wherein the sulphur content of the composition is at most 0.05% by weight.

24. The method of claim 23 wherein the fuel oil is a middle distillate fuel oil.

25. The method of claim 23 wherein the fuel oil is a diesel fuel.

* * * * *